United States Patent [19]

Tsukui et al.

[11] Patent Number: 4,990,825

[45] Date of Patent: Feb. 5, 1991

[54] CATHODE RAY TUBE HAVING STRESS RESISTANT FRAME

[75] Inventors: Keitaro Tsukui; Junko Itoh, both of Amagasaki; Koji Nakamura, Nagaokakyo, all of Japan

[73] Assignee: Mitsubishi Denki Kabushiki Kaisha, Tokyo, Japan

[21] Appl. No.: 405,275

[22] Filed: Sep. 11, 1989

[30] Foreign Application Priority Data

Sep. 20, 1988 [JP] Japan ..... 63-236047

[51] Int. Cl.[5] ..... H01J 29/86; H01J 29/87

[52] U.S. Cl. ..... 313/482; 313/479; 358/245

[58] Field of Search ..... 313/477 R, 479, 482; 358/245, 246, 247

[56] References Cited

U.S. PATENT DOCUMENTS

| | | | |
|---|---|---|---|
| 2,866,187 | 12/1958 | Fisch | 358/245 |
| 3,404,769 | 10/1968 | Bishop | 220/2.3 |
| 4,016,364 | 4/1977 | Rogers | 358/245 |
| 4,054,913 | 10/1977 | Lerner | 358/246 |
| 4,720,657 | 1/1988 | Tischer | 313/497 |

FOREIGN PATENT DOCUMENTS 1513809 12/1974 United Kingdom .

OTHER PUBLICATIONS

"Design of a CRT with a Nearly Flat Glass Face Plate and a Non-Glass Funnel Using Finite-Element Analysis" to Jain et al, *Proceedings of the Society for Information Display* (SID), vol. 27/4 (1986), New York, N.Y., USA.

"Recent Improvements in the 21AXP22 Color Kinescope" by R. B. Janes, L. B. Headrick, J. Evans. RCA Tube Division, Lancaster, Pa., pp. 143-145.

"The CBS-Colortron: A Picture Tube of Advanced Design" by N. F. Flyer, W. E. Rowe, C. W. Cain, Proceedings of the I-R-E, Jan., pp. 326-334.

"Phosphor-Strip Tricolor Tubes" by E. O. Lawrence, pp. 89-91.

"Frit-Sealed Metal—Glass CRTs with Near-Flat Faceplates" by Peter Seats, Thomas Electronics, Inc., Wayne, N.J., SID 84 Digest, pp. 342-344.

*Primary Examiner*—Sandra L. O'Shea

[57] ABSTRACT

A cathode ray tube for use as a video display or the like includes a panel, a funnel, and a stress resistant frame having an L-shaped bend and constituted by a metal frame joined to both the panel and the funnel. The stress resistant frame is adapted to reinforce the cathode ray tube against a tensile stress occurring due to a reduction in the internal pressure of the cathode ray tube.

34 Claims, 4 Drawing Sheets

CATHODE RAY TUBE HAVING STRESS RESISTANT FRAME

BACKGROUND OF THE INVENTION

The present invention relates to a cathode ray tube for use as a television picture tube or the like.

An electron tube for projecting cathode rays to a face plate so as to produce an image on the face plate, i.e., a so-called cathode ray tube (hereinafter abbreviated as the CRT), is used for a television receiver, for example. The CRT has, in recent years, been most popularly used as a display unit for displaying video information.

FIG. 6 is a partial and side elevational view, partly in section, of an example of a conventional CRT. Illustrated in the drawing are a panel 1, which includes a face plate 1*a* disposed in the front and adapted to display an image thereon and a panel skirt 1*b* disposed in an outer periphery thereof in such a manner as to extend therefrom, and a funnel 2, which constitutes a side wall formed of glass and connected to a neck (not shown) incorporating an electron gun.

The panel 1 and the funnel 2 are joined at an adjoining surface 3 by means of glass soldering or the like. A metallic band 4 is wound around the panel skirt 1*b*.

In the production of a CRT thus constructed, it is necessary to reduce the internal pressure of the CRT and maintain its interior in a vacuum. At that juncture, a compressive stress and a tensile stress accompanying the pressure reduction occur in the panel 1 and the funnel 2.

FIG. 7, which is a partial perspective view of the CRT shown in FIG. 6, illustrates portions where a compressive stress and a tensile stress take place at the time of the reduction of internal pressure. A tensile stress ordinarily takes place in the shadowed portions in FIG. 7.

Generally, the glass constituting the panel 1 and the funnel 2 exhibit a high strength against the compressive stress, but exhibit a relatively low strength against the tensile stress. In particular, in a case where a fine flaw is present on an outer surface thereof, its strength against the tensile stress declines further. During the fabrication of the panel 1 and the funnel 2, damage leading to such a decline in tensile strength is liable to occur.

Thus, in the conventional CRT having the arrangement such as the one shown in FIG. 6, since the panel 1 and the funnel 2 are formed of glass, the strength against a tensile stress is low due to the reduction in the internal pressure. Therefore, in order to secure a sufficient strength, it is necessary to enlarge the thickness of the glass. This disadvantageously makes the CRT heavy in weight.

As another type of arrangement of a conventional CRT, as shown in FIG. 8, there is shown one which includes a glass panel 11 and a metallic funnel 12. Such a CRT is disclosed in, for instance, Japanese Patent Laid-Open No. 34983/1981. In such a CRT as well, tensile stress due to a pressure reduction takes place at a joint portion between the panel 11 and the funnel 12, presenting a problem similar to the one encountered with the CRT shown in FIG. 6.

SUMMARY OF THE INVENTION

Accordingly, an object of the present invention is to provide a CRT which is capable of securing a strength against a tensile stress occurring as a result of a reduction in internal pressure which can be made lightweight, thereby overcoming the above-described drawbacks of the conventional art.

To this end, in accordance with the present invention, there is provided a CRT including a panel having a rectangular face plate and formed of glass and a funnel constituting a side wall interposed between the panel and a neck incorporating an electron gun disposed in face-to-face relation with the face. The CRT includes a stress resistant frame having an L-shaped bend and constituted by a metal frame joined to both the panel and the funnel. The stress resistant frame is adapted to reinforce the CRT against a tensile stress occurring due to a reduction in the internal pressure of the CRT.

This stress resistant frame may be provided on a CRT in which the funnel if formed of a metal.

The stress resistant frame may be arranged integrally with the funnel, and in this case the fabrication process of the stress resistant frame and the funnel can be partially omitted, thereby reducing the production costs.

If the thermal expansion coefficient of the stress resistant frame is made substantially equal to that of the panel, a joint portion between the stress resistant frame and the panel can be provided with a strength against a stress occurring due to the difference between the thermal expansion coefficients.

If the joining of the stress resistant frame and the panel is effected at a portion where the tensile stress occurring due to the evacuation of the interior of the CRT is sufficiently small, the joint portion between the stress resistant frame and the panel can be provided with a strength against a stress occurring due to the difference between the thermal expansion coefficients.

If a groove for imparting resiliency to the stress resistant frame is provided on the inner side of the L-shaped bend of the stress resistant frame, the stress applied to the panel and the funnel can be absorbed by the stress resistant frame. This thereby improves the strength of the CRT against the stress.

If one end of the stress resistant frame projects partially over the panel, the strength of the panel against the stress can be improved.

The provision of an insulating sheet for covering the surface of the stress resistant frame facing the outside of the CRT improves safety against a high tension when the high tension occurs in the stress resistant frame.

In a case where the stress resistant frame is arranged integrally with the funnel, if the insulating sheet is made to extend partially over the funnel, the safety of the funnel against a high tension can be ensured.

In addition, the provision of a front glass plate on the front surface of the face plate prevents the scattering of fragments caused by the breakage of the face plate.

The above and other objects, features and advantages of the present invention will become more apparent from the following detailed description of the invention when read in conjunction with the accompanying drawings.

DESCRIPTION OF THE PREFERRED EMBODIMENTS

Referring now to the accompanying drawings, a description will be given of the preferred embodiments of the present invention.

Figure 1:
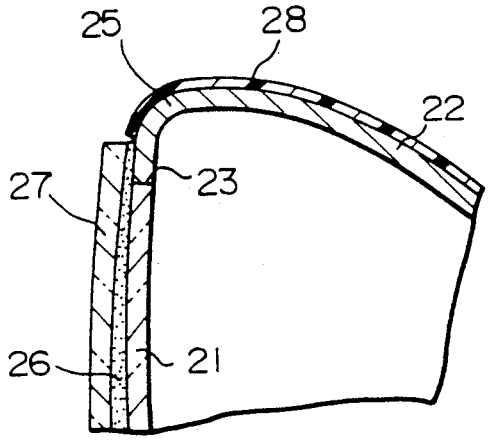
FIG. 1 is a partial cross-sectional view illustrating the arrangement of a first embodiment of a CRT in accordance with the present invention, in which a stress resistant frame 25, a feature of the invention, is arranged integrally with a funnel 22.

In FIG. 1, a stress resistant frame 25, which is a feature of the invention, is connected to a peripheral portion of a panel 21 and is formed of a metal. In this embodiment, a funnel 22 is also formed of a metal member and is formed integrally with the stress resistant frame 25. The central portion of the panel 21, i.e., the portion where an image is displayed, is formed of glass, such as H8602 specified in the standards of the Electronic Industries Association of Japan (EIAJ). As the material of the panel 25, a metal such as a carbon steel is used whose thermal expansion coefficient is substantially equal to that of the glass constituting the panel 21 and which produces a little amount of gas when the CRT is evacuated. In addition, the panel 21 and the stress resistant frame 25 are coupled with each other by means of frit glass. An explosion-proof front glass plate 27 is provided on the front surface of the panel 21 via a resin 26. This front glass plate 27 is an additional one for preventing fragments of the panel 21 from scattering toward the front should the CRT become broken. In the case of a compact CRT, for instance, the energy at the time of breaking is small, so that it is unnecessary to provide the front glass plate 27.

In addition, an insulating sheet 28 is provided on the outer surfaces of the stress resistant frame 25 and the funnel 22 for providing insulation. For instance, when the CRT is being used, a high voltage is produced in the funnel 22 and the stress resistant frame 25. This insulating sheet 28 is effective in preventing an accident caused by the high voltage.

Figure 2:
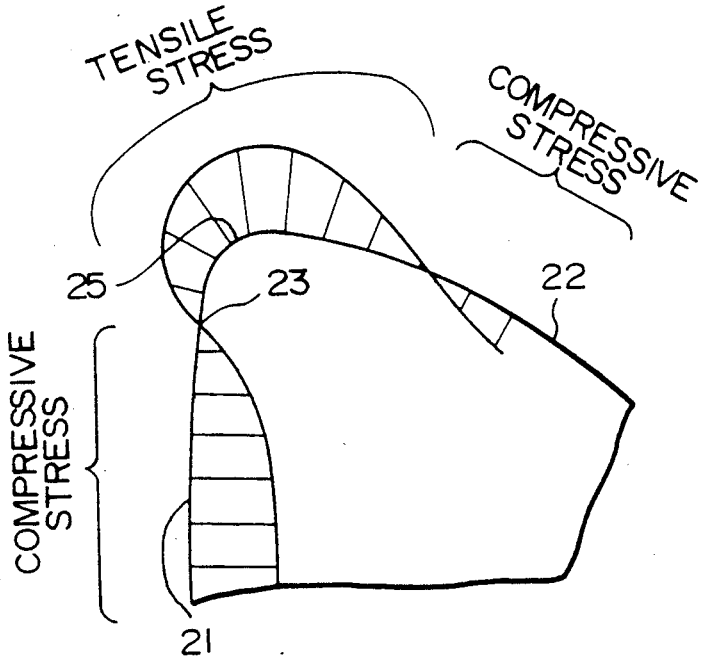
FIG. 2 is a map illustrating the distribution of stress occurring as a result of a reduction of the internal pressure of the CRT shown in FIG. 1, in which the portion undergoing transition from compressive stress to tensile stress corresponds to a joint surface 23 between the stress resistant frame 25 and a joint surface 23 of the funnel 22.

When the interior of the CRT thus constructed is evacuated, a stress displaying a distribution such as the one shown in FIG. 2 takes place on the CRT surface. In other words, a compressive stress is produced on the surface of the panel 21, while a tensile stress is produced in the stress resistant frame 25. At this time, since the stress resistant frame 25 is made of a metal, allowable stress against a tension is high, so that the thickness of the stress resistant frame 25 may be small. In addition, the stress resistant frame 25 is provided in such a manner that the stress becomes extremely small at a joint surface 23 between the panel 21 and the stress resistant frame 25.

Although in the above-described embodiment the stress resistant frame 25 and the funnel 22 are formed integrally, the two members may be welded together and assembled after fabricating them separately. Additionally, the funnel 22 may be fabricated in segments and then assembled by welding.

Figure 3:
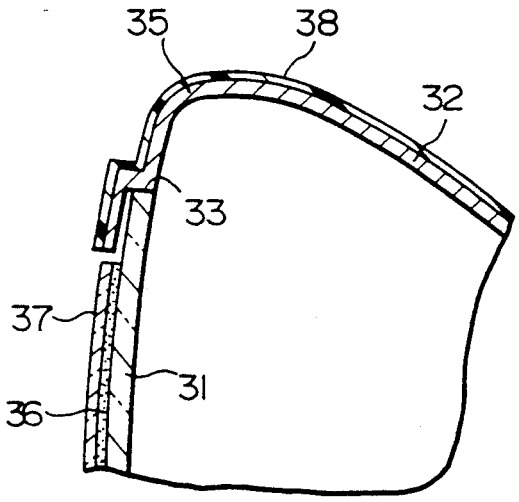
FIG. 3 is a partial cross-sectional view illustrating the arrangement of a second embodiment of the CRT in accordance with the present invention, in which one end of a stress resistant frame 35 projects over a panel 31 and the reference numerals designate 32—funnel, 33—joint surface, 36—resin, 37—glass plate, and 38—insulating sheet, respectively.

Furthermore, as shown in FIG. 3, a part of a stress resistant frame 35 may be provided extending partially over the front of the panel 31.

Figure 4:
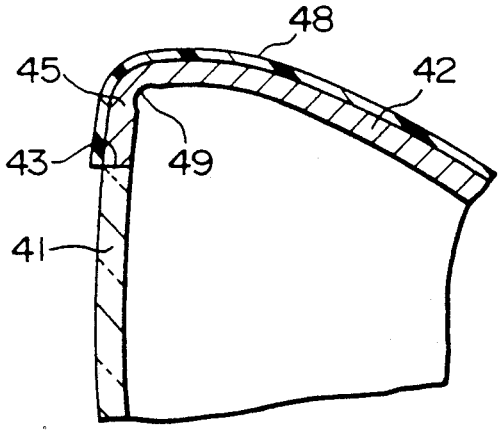
FIG. 4 is a partial cross-sectional view illustrating the arrangement of a third embodiment of the CRT in accordance with the present invention, in which a groove for imparting resiliency to a stress resistant frame 45 is provided on the bent inner side of the stress resistant frame 45 and the reference numerals designate 43—joint surface and 48—insulating sheet, respectively.

Moreover, as shown in FIG. 4, if the thickness of a stress resistant frame 45 is made small at a corner portion, it is possible to further reduce the stress acting on a panel 41 and a funnel 42 by virtue of the resiliency of this groove 49. Hence, it is possible to make the thickness of the panel 41 even smaller, making it possible to provide a more lightweight CRT.

In the embodiment shown in FIG. 4, since the thickness of the panel 41 is small, it is possible to obtain the advantage of reducing a thermal stress occurring in the panel 41 in a heating and exhausting process in the fabrication of the CRT, thereby facilitating fabrication and reducing the production costs.

Figure 5:
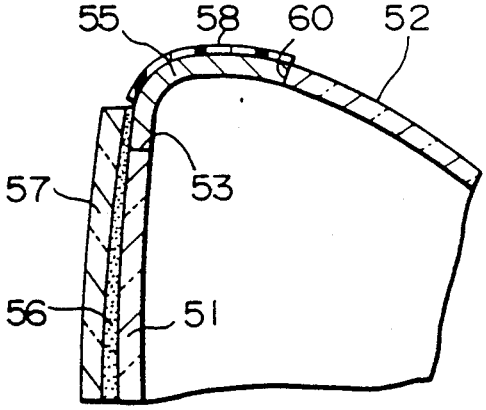
FIG. 5 is a partial cross-sectional view illustrating the arrangement of a fourth embodiment of the CRT in accordance with the present invention, in which a stress resistant frame 55 and a funnel 52 are arranged separately and the reference numerals designate 51—panel, 53—joint surface, 56—resin, 57—glass plate and 58—insulating sheet, respectively.
Figure 6:
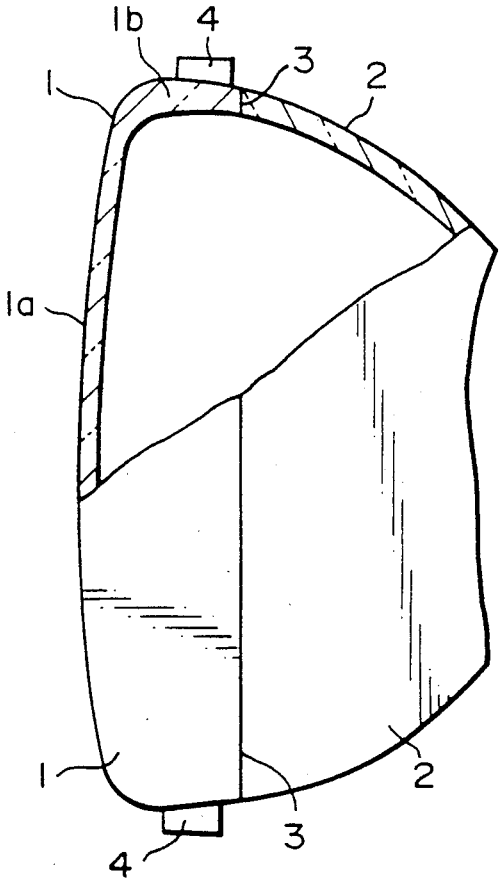
FIG. 6 PRIOR ART
FIG. 6 is a partial view, partly in section, of an example of the arrangement of a conventional CRT, in which the CRT includes a panel 1 and a funnel 2 both of which are formed of glass.
Figure 8:
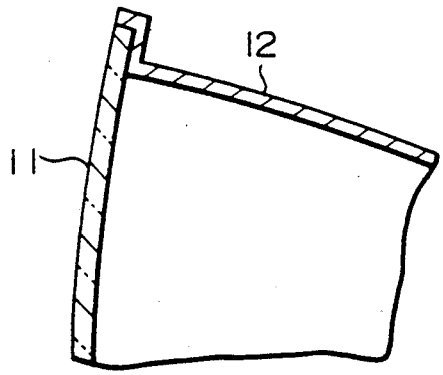
FIG. 8 PRIOR ART
FIG. 8 is a partial cross-sectional view illustrating another example of the arrangement of a conventional CRT, in which the CRT includes a metallic funnel 12 and a glass panel 11.
Figure 7:
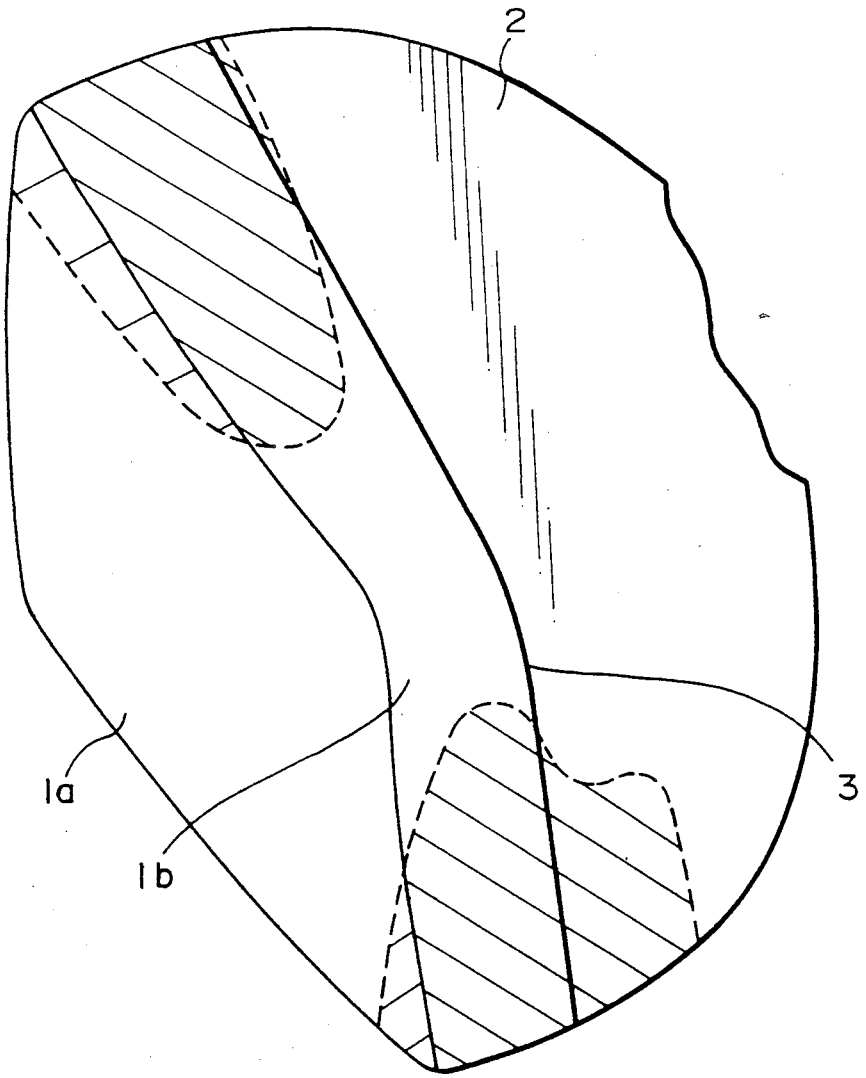
FIG. 7 PRIOR ART
FIG. 7 is a partial perspective view illustrating the distribution of stress during a reduction in the internal pressure of the conventional CRT shown in FIG. 6.

As shown in FIG. 5, since a compressive stress is applied to a funnel 52, the funnel 52 may be formed of glass and may be joined with a stress resistant frame 55 by means of frit glass or the like at a surface 60 where the compressive stress turns into the tensile stress.

In the respective embodiments described above, it is possible to obtain a CRT which is lightweight and has a high strength against a tensile stress.

What is claimed is:

1. A cathode ray tube including a panel having a rectangular face plate and formed of glass and a funnel constituting a side wall interposed between the panel and a neck incorporating an electron gun disposed in face-to-face relation with said face plate, said cathode ray tube comprising:

a stress resistant frame made of metal and having an L-shaped bend and including a groove in the inner side of said L-shaped bend for imparting resiliency to said stress resistent frame, said stress resistant frame interconnecting said panel and said funnel, whereby said stress resistant frame is adapted to reinforce said cathode ray tube against a tensile stress occurring due to a reduction in internal pressure of said cathode ray tube.

2. The cathode ray tube of claim 1, wherein said funnel is formed of a metal.

3. The cathode ray tube of claim 1, wherein the thermal expansion coefficient of said panel is substantially equal to that of said stress resistant frame.

4. The cathode ray tube of claim 1, wherein the joining of said panel and said stress resistant frame is effected at a portion where the tensile stress occurring due to the evacuation of the interior of said cathode ray tube is sufficiently small.

5. The cathode ray tube of claim 1, wherein the joining of said funnel and said stress resistant frame is effected at a portion where the tensile stress occurring due to the evacuation of the interior of said cathode ray tube is sufficiently small.

6. The cathode ray tube of claim 1, wherein one end of said stress resistant frame extends partially over said panel.

7. The cathode ray tube of claim 1, further comprising an insulating sheet formed of an insulating material and adapted to cover the surface of said stress resistant frame facing the outside of said cathode ray tube.

8. The cathode ray tube of claim 1, further comprising a front glass plate disposed on the front surface of said face plate so as to prevent the scattering of fragments upon said face plate being broken.

9. The cathode ray tube of claim 4, wherein the joining of said funnel and said stress resistant frame is effected at a portion where the tensile stress occurring due to the evacuation of the interior of said cathode ray tube is sufficiently small.

10. The cathode ray tube of claim 3, wherein the joining of said panel and said stress resistant frame is effected at a portion where the tensile stress occurring due to the evacuation of the interior of said cathode ray tube is sufficiently small, while the joining of said funnel and said stress resistant frame is effected at a portion where the tensile stress occurring due to the evacuation of the interior of said cathode ray tube is also sufficiently small.

11. The cathode ray tube of claim 10, further comprising an insulating sheet formed of an insulating material and adapted to cover the surface of said stress resistant frame facing the outside of said cathode ray tube; and a front glass plate disposed on the front surface of said face plate so as to prevent the scattering of fragments, said face plate being broken.

12. A cathode ray tube according to claim 2, wherein said funnel and said stress resistant frame are formed integrally.

13. The cathode ray tube of claim 2, further comprising an insulating sheet formed of an insulating material and adapted to cover the surface of said stress resistant frame facing the outside of said cathode ray tube, said insulating sheet covering said funnel formed integrally with said stress resistant frame.

14. The cathode ray tube of claim 12, further comprising an insulating sheet formed of an insulating material and adapted to cover the surface of said stress resistant frame facing the outside of said cathode ray tube, said insulating sheet covering said funnel formed integrally with said stress resistant frame.

15. The cathode ray tube of claim 14, wherein the thermal expansion coefficient of said panel is substantially equal to that of said stress resistant frame, the joining of said panel and said stress resistant frame being effected at a portion where the tensile stress occurring due to the evacuation of the interior of said cathode ray tube is sufficiently small.

16. The cathode ray tube of claim 14, wherein the thermal expansion coefficient of said panel is substantially equal to that of said stress resistant frame, the joining of said panel and said stress resistant frame being effected at a portion where the tensile stress occurring due to the evacuation of the interior of said cathode ray tube is sufficiently small, and a front glass plate being disposed on the front surface of said face plate so as to prevent the scattering of fragments upon said face plate being broken.

17. The cathode ray tube of claim 16, wherein one end of said stress resistant frame extends partially over said panel.

18. A cathode ray tube including a panel having a rectangular face plate and formed of glass and a funnel formed of metal constituting a side wall interposed between the panel and a neck incorporating an electron gun disposed in face-to-face relation with said face plate, said cathode ray tube comprising:

a stress resistant frame, made of metal and having an L-shaped bend, formed integral with the funnel, said stress resistant frame being connected to the panel;

whereby said stress resistant frame is adapted to reinforce said cathode ray tube against a tensile stress occurring due to a reduction in the internal pressure of said cathode ray tube.

19. The cathode ray tube of claim 18, wherein the thermal expansion coefficient of said panel is substantially equal to that of said stress resistant frame.

20. The cathode ray tube of claim 18, wherein the joining of said panel and said stress resistant frame is effected at a portion where the tensile stress occurring due to the evacuation of the interior of said cathode ray tube is sufficiently small.

21. The cathode ray tube of claim 18, wherein the joining of said funnel and said stress resistant frame is effected at a portion where the tensile stress occurring due to the evacuation of the interior of said cathode ray tube is sufficiently small.

22. The cathode ray tube of claim 18, wherein a groove for imparting resiliency to said stress resistant frame is provided on an inner side of said L-shaped bend of said stress resistant frame.

23. The cathode ray tube of claim 18, wherein one end of said stress resistant frame extends partially over said panel.

24. The cathode ray tube of claim 18, further comprising an insulating sheet formed of an insulating material and adapted to cover the surface of said stress resistant frame facing the outside of said cathode ray tube.

25. The cathode ray tube of claim 18, further comprising a front glass plate disposed on the front surface of said face plate so as to prevent the scattering of fragments upon said face plate being broken.

26. The cathode ray tube of claim 20, wherein the joining of said funnel and said stress resistant frame is effected at a portion where the tensile stress occurring due to the evacuation of the interior of said cathode ray tube is sufficiently small.

27. The cathode ray tube of claim 19, wherein the joining of said panel and said stress resistant frame is effected at a portion where the tensile stress occurring due to the evacuation of the interior of said cathode ray tube is sufficiently small, while the joining of said funnel and said stress resistant frame is effected at a portion where the tensile stress occurring due to the evacuation of the interior of said cathode ray tube is also sufficiently small.

28. The cathode ray tube of claim 27, wherein a groove for imparting resiliency of said stress resistant frame is provided on an inner side of said L-shaped bend of said stress resistant frame.

29. The cathode ray tube of claim 27, further comprising an insulating sheet formed of an insulating material and adapted to cover the surface of said cathode ray tube; and a front glass plate disposed on the front surface of said face plate so as to prevent the scattering of fragments upon said face plate being broken.

30. The cathode ray tube of claim 18, further comprising an insulating sheet formed of an insulating material and adapted to cover the surface of said stress resistant frame facing the outside of said cathode ray tube, said insulating sheet covering said funnel formed integrally with said stress resistant frame.

31. The cathode ray tube of claim 30, wherein the thermal expansion coefficient of said panel is substantially equal to that of said stress resistant frame, the joining of said panel and said stress resistant frame being effected at a portion where the tensile stress occurring due to the evacuation of the interior of said cathode ray tube is sufficiently small, and a groove for imparting resiliency to said stress resistant frame being provided on the inner side of said L-shaped bend of said stress resistant frame.

32. The cathode ray tube of claim 30, wherein the thermal expansion coefficient of said panel is substantially equal to that of said stress resistant frame, the joining of said panel and said stress resistant frame being effected at a portion where the tensile stress occurring due to the evacuation of the interior of said cathode ray tube is sufficiently small, and a front glass plate being disposed on the front surface of said face plate so as to prevent the scattering of fragments upon said face plate being broken.

33. The cathode ray tube of claim 32, wherein one end of said stress resistant frame extends partially over said panel.

34. The cathode ray tube of claim 33, wherein a groove for imparting resiliency to said stress resistant frame is provided on the inner side of said L-shaped bend of said stress resistant frame.

* * * * *